US005965053A

United States Patent [19]

Carlson

[11] Patent Number: 5,965,053

[45] Date of Patent: Oct. 12, 1999

[54] PENETRATABLE FORM WITH STIFFBACK

[75] Inventor: Michael G. Carlson, Lenexa, Kans.

[73] Assignee: Western Forms, Inc., Kansas, Mich.

[21] Appl. No.: 08/833,529

[22] Filed: Apr. 7, 1997

[51] Int. Cl.[6] ..... E04G 17/14

[52] U.S. Cl. ..... 249/191; 249/45; 249/47; 249/213; 249/219.1

[58] Field of Search ..... 249/191, 192, 249/193, 44, 45, 47; 52/235, 464, 468, 204.593

[56] References Cited

U.S. PATENT DOCUMENTS

| | | | |
|---|---|---|---|
| 2,731,118 | 1/1956 | Nasmyth | 52/235 |
| 2,914,145 | 11/1959 | Benson | 52/235 |
| 3,028,938 | 4/1962 | Schorr | 52/464 |

OTHER PUBLICATIONS

*A New Generation in Aluminum Forming Systems* brochure (12 pgs.); published 1988 by Western Forms, Inc.

*Concrete Forming Accessories* brochure—cover page, pp. 2, 16–18, 25, 26, 29, 30, and 32; published 1994 by Western Forms, Inc.

*The World's Leading Innovator In Aluminum Forming Systems* brochure (12 pgs.); published 1993 by Western Forms, Inc.

Aluma–Systems brochure, published 1986 by Aluma Systems Incorporated; cover page, pp. 3 and 20.

*Primary Examiner*—Michael Safavi

*Attorney, Agent, or Firm*—Hovey, Williams, Timmons & Collins

[57] ABSTRACT

A penetratable stiffback useful as a building form is provided and is useful as an integrated member of a forming system in conjunction with a pair of forming panels. The stiffback includes a face panel and a pair of rearwardly projecting support walls, each support wall including a lug projecting outwardly therefrom intermediate the rear margin and the rear of the face panel. The face panel includes a front face for location coplanar with a pair of adjacent forming panels to present a forming system for receiving hardenable material thereagainst, the lugs serving to reinforce the panels on either side. The system includes a connecting member for penetrating the face panel and connection to an opposing forming wall to inhibit separation of the forming walls caused by the weight of the hardenable material poured between the forming walls.

12 Claims, 2 Drawing Sheets

12
20
18
74
86
110
16
10
26
10
22
110
54
76
14
84
80
74
52
110
86
50
90
80
46
72
102
108
96
24
82
98
100
110
70
94
92
68
94
78

PENETRATABLE FORM WITH STIFFBACK

BACKGROUND OF THE INVENTION

1. Field of the Invention

This invention concerns a building form and system for forming hardenable material such as concrete. More particularly, it is concerned with a method, stiffback and building form system which permits the stiffback to be used as a penetratable building form.

2. Description of the Prior Art

Building forms are widely used to form walls, foundations and the like of hardenable material such as concrete. Such building forms may be of different materials such as wood or foam, but these typically lack durability for repeated usage. Thus, reusable building forms are more often of metal, such as aluminum which is lightweight and durable. In constructing foundations out of such building forms, panels are typically interconnected in side-by-side relationship to comprise a forming wall, and another such forming wall is opposed thereto to receive the concrete or other flowable, hardenable and typically cementations material therebetween. To provide rigidity, especially for greater depths of material, intermediate cross-beams may be provided on the back side of the building form panels making up the forming walls.

Because of the great weight of the concrete material received between the forming walls, stiffbacks are employed behind the panels to provide support and resist deflection of the panels outwardly from the material receiving area. The stiffbacks are positioned in an upright orientation behind the panels at selected intervals and may be connected to the back of the forming panels by bolting or similar fastening means. To provide further resistance to separation, tapered connecting rods penetrate through openings drilled in the panels of opposing walls and pass through the material receiving region between the opposing panels to tie the building forms of the opposing forming walls together against separation.

While this system and method is useful, it is also expensive as drilling a hole through a building form renders it unsuitable for further use. Unless the hole is repaired by expensive welding due to the usually aluminum material, the entire panel must be replaced. Moreover, in addition to the panels which spanned the entire width of the wall, additional stiffback members were required to reinforce the wall. Consequently, the resulting total cost of materials of a wall including both stiffbacks and panels is greater than the panel alone.

There has thus developed a need for an economical building form system which can be readily erected and used with existing ancillary equipment.

SUMMARY OF THE INVENTION

These and other objects are largely met by the present invention. That is to say, the present invention provides a stiffback which may be used as a building form and as such, reduces the total cost of materials necessary in connection with providing a sustainable building wall. Moreover, because the stiffback is much narrower than a building panel with which it is used, the provision of a penetratable stiffback avoids the necessity of replacing an entire panel after penetration.

The stiffback of the presentation is a penetratable building form presenting a relatively narrow face panel with a face for orientation toward the hardenable material and a pair of spaced apart support walls extending rearwardly from the rear surface to define a channel therebetween. The stiffback is provided with a side lug on each of the support walls for engagement or positioning in proximity to forming panels located on either side of the stiffback, and cooperates with the side panels to increase rigidity of the forming system. An attachment member is positioned at the rear margin of each wall to facilitate attachment of braces, scaffolding or other accessories to the stiffback. In preferred forms, the attachment member extends outwardly from the support walls in an L-shaped extension which defines a gutter, with a slot defined to retain fasteners in the gutter. The stiffback face panel is adapted to be provided with an opening either when formed or during use (by drilling or the like), whereby a connecting member such as a tapered rod may be inserted through the face for inhibiting movement of the stiffback caused by the weight of the hardenable material.

The stiffback is preferably used in connection with standard forming panels to provide a forming system. The forming panels typically include a side rail which may abut the side lug of the stiffback, which is also connected by fasteners such as bolts, pins, or locking devices to the panels. Thus, the stiffback and panels cooperate together to provide a unitary forming system which resists shifting movement upon loading by hardenable material such as concrete into a material-receiving region between opposing forms. As noted above, the stiffback may be provided with an opening so that a connecting member may penetrate the face panel and tie opposing forming walls together. Typically, the forming walls are comprised of the stiffback and adjacent panels on one side and a corresponding stiffback and adjacent panels on the other to eliminate the need for any penetrating of the forming panels.

The method of the present invention includes providing a first forming wall of interconnected panels and a stiffback located therebetween, providing a second, opposing forming wall, providing an aperture in the face panel of the stiffback, inserting a connecting member therethrough and through a second aperture in the second forming wall to interconnect the first forming wall and the second forming wall, and delivering a flowable, hardenable material into the material receiving region defined between the first and second forming walls.

The stiffback and forming system hereof provide a significant improvement over the prior art, providing a stiffback which is integrated into the face of the forming wall. This results in a forming system of reduced thickness, which is especially beneficial in forming stairwells and elevator wells in buildings where the available space is restricted. By reducing the thickness or depth of the forming system used in creating the resulting walls, the forming system hereof makes installation and erection of the forms a simpler task, and may permit a wall to be poured of concrete or other hardenable material which would otherwise have been impossible or accomplished with great difficulty. Moreover, the use of a penetratable face on the stiffback avoids the necessity of penetrating a conventional panel, which may be more costly to replace, or even to repair given the reinforcements which may be used as a part thereof. The ability to penetrate the face panel of the stiffback further isolates the resulting point of weakness between the two supporting walls. The stiffback further cooperates with the ends of the supporting panels to reduce deflection under loading by the use of the side lugs which are positioned to inhibit undesired flexing of the sides of the panel and cooperate with the side rails. As a result, a highly satisfactory stiffback usable with conventional panels is provided, and the combined forming system presents advantages not present in the prior art.

This and other benefits of the present invention may be appreciated by those skilled in the art with reference to the drawings and the detailed description of the preferred embodiment set forth below.

DESCRIPTION OF THE PREFERRED EMBODIMENT

Figure 1:
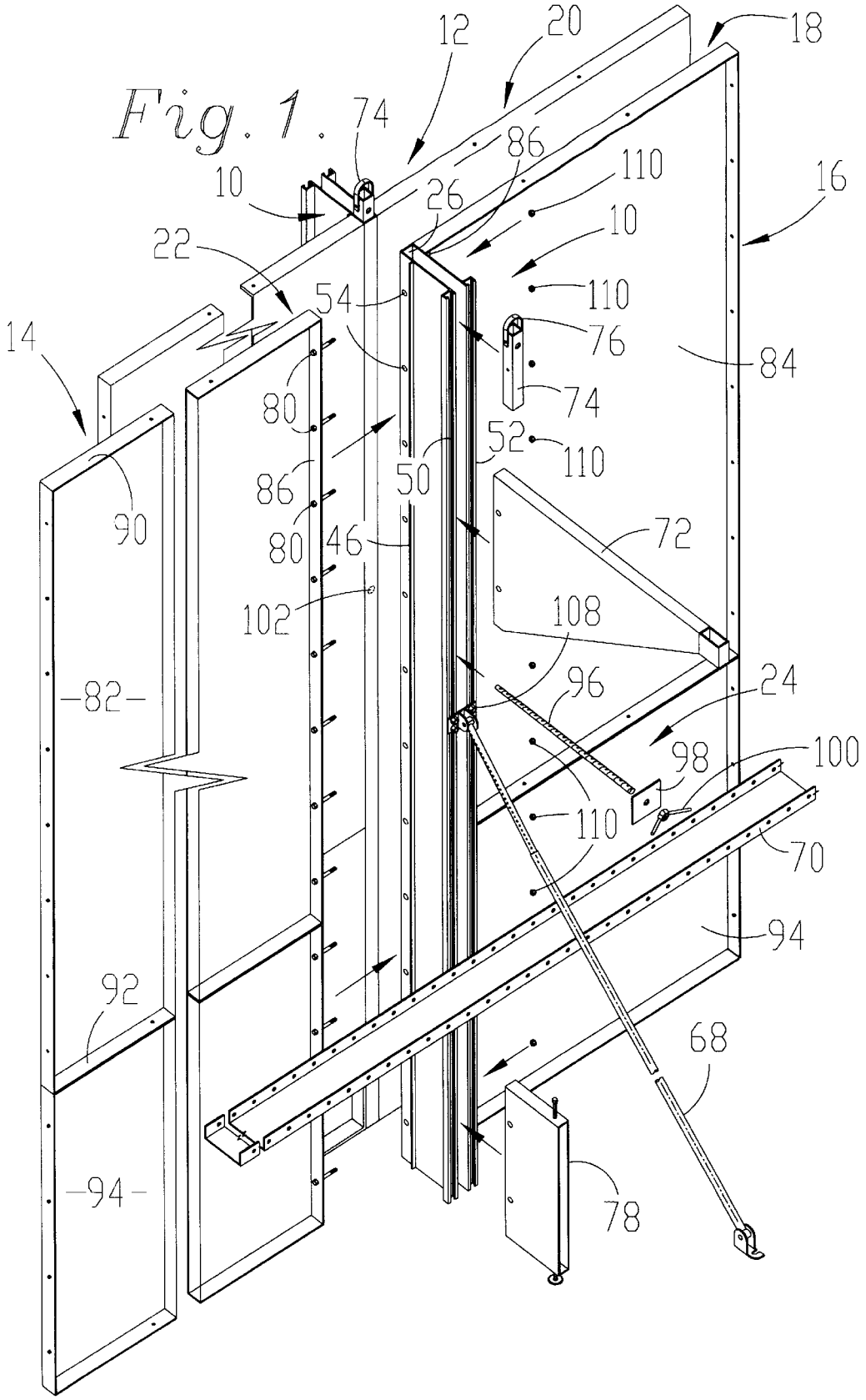
FIG. 1 is an exploded perspective view of the stiffback and forming system of the present invention, with two superposed forming panels foreshortened and optional attachments for use with the stiffback and forming system illustrated.

Referring now to the drawing, a penetratable stiffback building form 10 in accordance with the present invention is shown as a part of a forming system 12 in FIG. 1. The forming system 12 includes, in addition to the stiffback 10, a first forming panel 14 and a second forming panel 16. The stiffback 10 is positioned intermediate the first and second forming panels and interconnected therewith to present a first forming wall 18. A second forming wall 20 is preferably positioned opposite the first forming wall 18 to define therebetween a material receiving region 22. A connecting member 24 may be provided to interconnect the opposed first forming wall 18 and the second forming wall 20 against relative separation.

Figure 2:
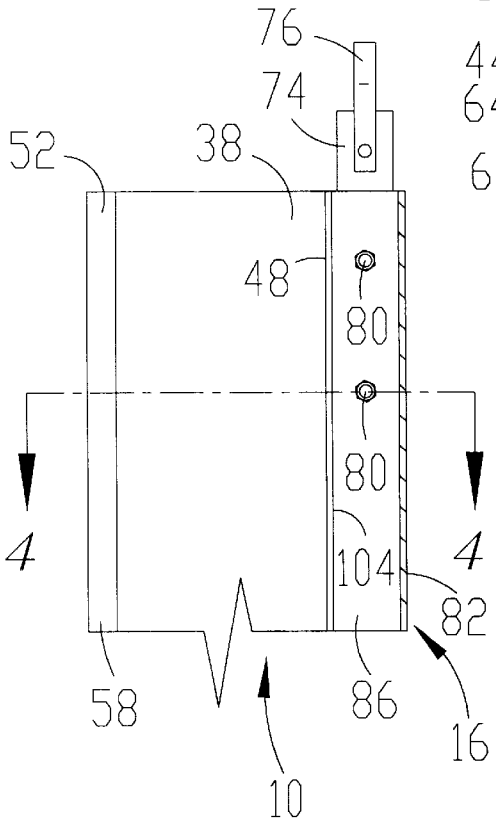
FIG. 2 is a fragmentary side elevational view of the stiffback in accordance with the present invention shown with an optional lifting bracket attached thereto.
Figure 4:
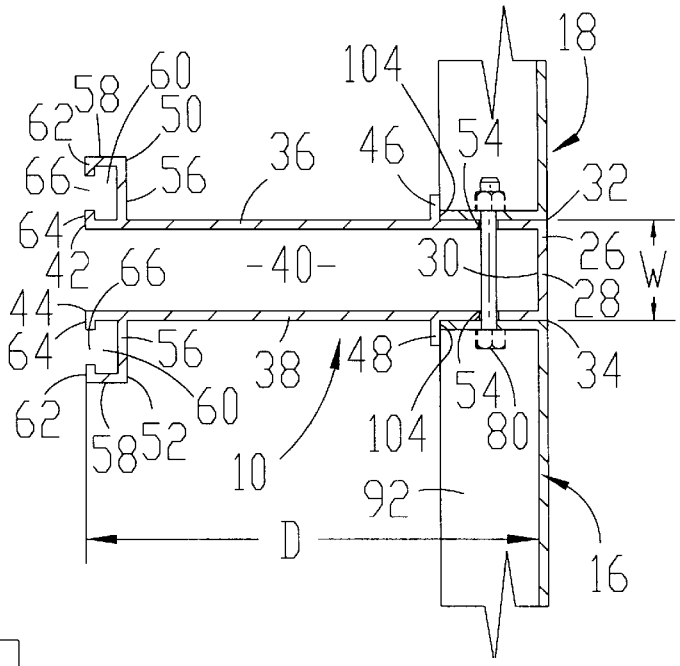
FIG. 4 is a fragmentary horizontal cross-sectional view of the stiffback located intermediate a pair of forming panels taken along line 4—4 of FIG. 2, showing the positioning of the rails of the forming panels to the side lugs of the stiffback.
Figure 3:
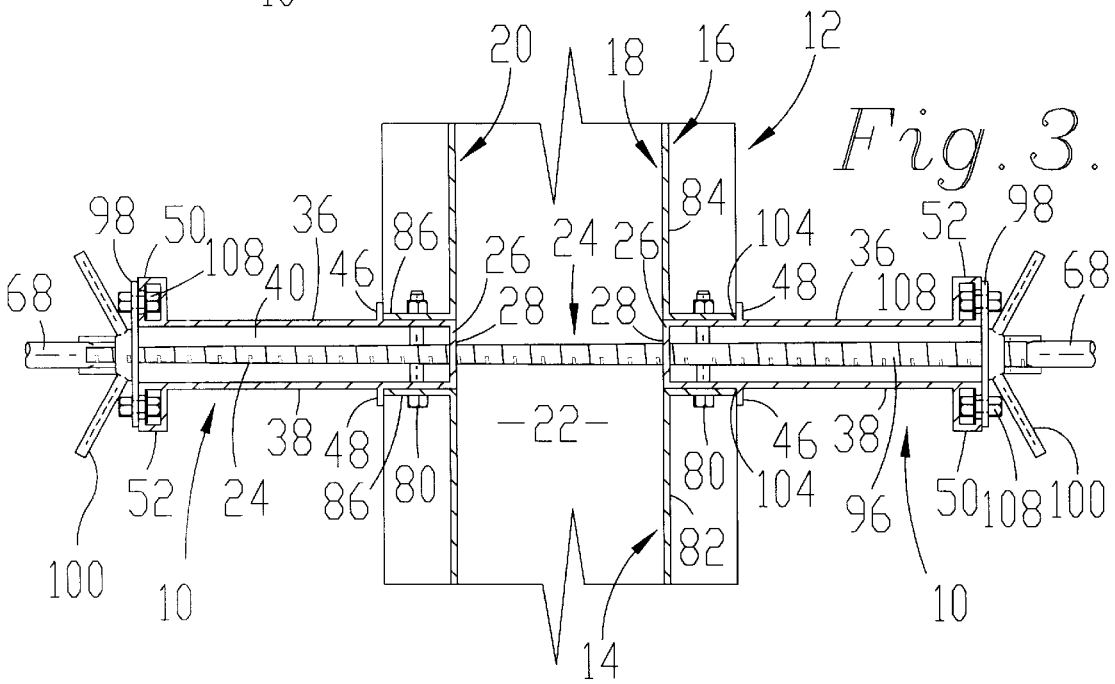
FIG. 3 is a fragmentary horizontal cross-sectional view of the forming system hereof, showing two opposed forming walls with a tapered connecting rod penetrating opposed stiffbacks and engaged with the rear margin of the support walls of each stiffback.

The stiffback 10 is preferably of aluminum or other durable, lightweight metal and is shown in greater detail in FIGS. 2–4. The stiffback 10 and includes an elongated face panel 26 which is typically, though not necessarily vertically oriented. The face panel 26 includes a front face 28 and a rear surface 30 and a pair of side edges 32 and 34 defining a width W therebetween.

First support wall 36 and second support wall 38 extend rearwardly from rear surface 30 adjacent side edges 32 and 34, respectively. The first and second support walls preferably extend the entire longitudinal distance of the face panel 26 to provide support throughout the entire length thereof. The first support wall 36 and second support wall 38 are preferably in parallel planes and define therebetween a channel 40. The first support wall 36 and second support wall are preferably oriented perpendicular to the face panel 26 and extend rearwardly to respective rear margins 42 and 44 for a depth D which is greater than the width W of the face panel 26 to provide adequate structural stiffness and support.

Each of the first and second support walls is provided with a lug 46, 48 which projects laterally from the respective support wall 36, 38 and preferably extends the entire length thereof. The lugs 46, 48 are positioned rearwardly of the rear surface of the face panel 26 and forwardly of an attachment member 50, 52 proximate the rear margins 42, 44. A plurality of connection holes 54 are spaced along the length of each of the support walls 36, 38, so that a connection hole 54 of the first support wall 36 is opposite and in registry with the connection hole 54 of the second support wall 38. The connection holes 54 are positioned on the support walls forwardly of the lugs and rearwardly of the rear surface 30.

The attachment members 50 and 52 are L-shaped and preferably extend laterally from the support walls outside the channel 40 the entire length of the stiffback 10. Each attachment member 50, 52 includes a leg 56 extending perpendicular to the support wall and a foot 58 extending rearwardly and parallel to its respective support wall to define a gutter 60 therebetween. The gutter 60 is sized to receive a bolt head, nut or the like therein, which in turn is restrained from further rearward movement by convergent rails 62, 64 oriented parallel to the leg and defining a slot 66 therebetween. The slot 66 permits vertical movement of a bolt shank therealong as illustrated in FIG. 1, but the rails 62 and 64 of each attachment member restrain the bolt head or nut in the gutter 60 from rearward movement. Each of the rails 62, 64 of the attachment members preferably extend the length of the stiffback 10 and are coplanar with one another at the rear margin 42, 44 of the respective support wall.

The attachment members 50, 52 are thus configured for connection with accessories such as an expandable wall brace 68 or a horizontal waler 70. In addition, accessories such as a scaffold bracket 72, a lifting bracket 74 with clevis 76 and a gang leveler 78 may be secured to the support walls 36 and 38 by bolts 80 or other fasteners passing through connection holes 54.

Forming panels 42 and 44 each include respective face plates 82 and 84, and side rails 86 which are of a depth equivalent to the distance between face panel 26 and lugs 46, 48. The side rails 86 are provided with a plurality of holes 88 which are spaced corresponding to the spacing of the connection holes 54 of the support walls. The forming panels 14 and 16 also include upper rails 90 and lower rails 92 for connection by bolts 80 to the rails on other such panels 94 in superposed relationship to achieve the desired height for the wall to be formed. It may be appreciated that the forming panels 42 and 44 may include, in addition, corner gussets, rigid box braces extending either horizontally or vertically behind the face sheet of the panel for added support and rigidity, and attachment hardware base plates and pins as is known in the art.

The connection member 24 is provided to interconnect the first and second forming walls. The connection member 24 includes a tapered tie rod 96, an engagement bracket 98 and a threaded wing nut 100. The face panel 26 of the stiffback 10 in each of the first and second forming walls 18, 20 is provided with an aperture 102 at the desired height during installation. As shown in FIG. 4, the tapered tie rod 96 spans the material receiving region between the face of each of the opposed stiffbacks 10 of the respective first forming wall and second forming wall, with the engagement bracket 90 abutting the attachment members of each stiffback 10. The aperture 102 is preferably sized corresponding to the diameter of the tapered tie rod 96 to inhibit passage of concrete or other hardenable material therethrough. The aperture 102 is provided in the face panel between the support walls 36 and 38 as shown in FIG. 4 for maximizing strength of the stiffback 10, and the number of apertures 102 and their height along the length of the stiffback will depend on the height of the wall to be formed and the width of the forming system.

In use, the forming system 14 is first assembled by positioning the stiffback 10 intermediate the first and second forming panels 16 and 18, and such other panels 94 positioned therebeneath as required to provide a first forming wall 18 of desired height. The lower rails 92 are connected by bolts 80 and nuts 110 or pin-fastened using locking or conventional pins to the upper rails 90 of the panel 94 therebeneath. The side rails 86 are brought into engagement with the support walls 36 and 38 of the stiffback, with the connection holes 54 in registry with holes 88 on the side rails 86. Preferably, the connection holes 54 are positioned so that the margins 104 of the side rails 86 lie in abutment with the lugs 46 and 48 when bolts 80 are inserted through holes 54 and 88 and secured by nuts 106. The side rails 86 thus engage lugs 46 and 48 closely adjacent to support walls 36 and 38 to resist imparting a large moment to the lugs by the forming panels through the side rails, and thereby maximizing rigidity of the combined forming system 12. Additional forming panels and stiffbacks are alternated until the entire first forming wall is completed.

Once the first forming wall 18 is assembled, preferably including lifting bracket 74, the wall 18 is lifted into position, and a second forming wall 18 is positioned opposite first forming wall 18 preferably with the stiffbacks 10 in direct opposition as shown in FIG. 3, each forming wall 18, 20 being leveled as appropriate. To inhibit relative displacement between the forming walls due to the weight of the hardenable material deposited therebetween, apertures 102 are created by drilling or the like in the face panel 26 of each opposed stiffback 10. Preferably, the apertures are located vertically intermediate the junction between upper rails 90 and lower rails 92 to avoid a concentration of stress.

Connection member 24 secures the stiffbacks and thus the first and second walls against displacement by insertion of the tapered tie rod 96 through the apertures 102, placing the engagement brackets 98 over the ends of the rod 96, and tightening the wing nut 100 to bring the engagement brackets into engagement with the rear margins 42 and 44. Expandable wall brace 68 may then be secured to the attachment members 50 and 52 by suitable nuts and bolts 108 as shown in FIGS. 1 and 3, where the wall brace 68 is visible below the engagement bracket 98. With the first and second forming walls so positioned, hardenable material such as concrete is poured into the material receiving region 22 which accumulates to the desired height of the wall. The hardenable material may well reach a height greater than aperture 102 and surround tapered tie rod 96. However, the tapering of the tie rod 96 permits its withdrawal through the aperture 102 after the concrete or other material has cured to hardness, thereby permitting removal and reuse of the stiffbacks 10 and forming panels. After use, the stiffbacks 10 may be discarded or the apertures drilled therein repaired by welding plates or the like over the apertures.

The present invention thus provides an economical forming system which can be used in forming concrete walls where areas of only limited access are provided, such as elevator shafts and stairwells. Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. A forming system for retaining a hardenable material comprising:

a first forming panel presenting a first face plate having a first front surface for engagement with the hardenable material and a first side rail;

a second forming panel presenting a second face plate having a first front surface for engagement with the hardenable material and a second side rail;

a stiffback including:

an elongated face panel having a pair of side edges defining a width therebetween less than the length of said face panel and presenting a front face for engagement with the hardenable material and an opposite rear surface, first and second spaced-apart support walls extending rearwardly from said face panel opposite said face and defining therebetween a channel, each of said walls presenting a rear margin located at a greater depth from said rear surface than the width of said face panel, each of said support walls including a lug projecting transversely therefrom and opposite said channel for abutment with an adjacent forming panel, and an attachment member connected to said each of said support walls proximate said rear margin, each said attachment member including a leg extending transversely from said wall; and a fastener connecting respective first and second side rails of each of said first and second forming panels to respective ones of said first and second support walls with said face panel substantially coplanar with said respective first and second face plates and said lug on each of said first and second support walls positioned adjacent the respective first and second side rails of said first and second forming panels.

2. A forming system as set forth in claim 1, each of said first and second support walls of said stiffback defining at least one hole therethrough located intermediate said rear surface and said rear margin and adapted to receive said fastener therethrough for connecting to one of said adjacent forming panels.

3. A forming system as set forth in claim 2, wherein each of said holes is located rearwardly of said rear surface but relatively forwardly of said lug.

4. A forming system as set forth in claim 3, each of said attachment members including a foot projecting rearwardly from said leg to define a U-shaped gutter bounded by one of the support walls and its respective leg and foot.

5. A forming system as set forth in claim 4, wherein each of said feet of said stiffback presents a first rail oriented toward its respective support wall and said rear margin presents a second rail oriented toward said first rail to define therebetween a slot of restricted transverse dimension relative to said gutter.

6. A forming system as set forth in claim 5, wherein said leg on each said support wall of said stiffback is oriented away from said other support wall such that the distance between said feet is greater than the distance between said first and second support walls.

7. A forming system as set forth in claim 1, including a opposing forming wall located opposite said face panel, said stiffback including an aperture in said face panel and a connecting member extending through said aperture, said connecting member engaging said opposing forming wall and also engaging said rear margin for resisting displacement of said stiffback in a direction away from said opposing forming wall.

8. A stiffback for connection to an adjacent forming panel and for use as a building form for a hardenable material comprising:

an elongated face panel having a pair of side edges defining a width therebetween less than the length of said face panel and presenting a front face for engagement with the hardenable material and an opposite rear surface;

first and second spaced-apart elongated support walls each extending rearwardly from said rear surface of said face panel proximate said side edges and defining therebetween a channel, each of said support walls presenting a rear margin and having a depth defined between said rear surface and said rear margin, said support walls extending rearwardly a greater depth than said width of said face panel, each of said support walls including a lug projecting transversely therefrom and opposite said channel for abutment with an adjacent forming panel, each of said first and second support walls defining at least one hole therethrough located intermediate said rear surface and said rear margin and adapted to receive a fastener for connecting to an adjacent forming panel each of said holes being located rearwardly of said rear surface but relatively forwardly of said lug; and an attachment member connected to said each of said support walls proximate said rear margin, each said attachment member including a leg extending transversely from said wall.

9. A stiffback as set forth in claim 8, each of said attachment members including a foot projecting rearwardly from said leg to define a U-shaped gutter bounded by one of the support walls and its respective leg and foot.

10. A stiffback as set forth in claim 9, wherein each of said feet presents a first rail oriented toward its respective support wall and said rear margin presents a second rail oriented toward said first rail to define therebetween a slot of restricted transverse dimension relative to said gutter.

11. A stiffback as set forth in claim 10, wherein said leg on each said support wall is oriented away from said other support wall such that the distance between said feet is greater than the distance between said first and second support walls.

12. A stiffback for connection to an adjacent forming panel and for use as a building form for a hardenable material comprising:

an elongated face panel having a pair of side edges defining a width therebetween less than the length of said face panel and presenting a front face for engagement with the hardenable material and an opposite rear surface:

first and second spaced-apart elongated support walls each extending rearwardly from said rear surface of said face panel proximate said side edges and defining therebetween a channel, each of said support walls presenting a rear margin and having a depth defined between said rear surface and said rear margin, said support walls extending rearwardly a greater depth than said width of said face panel, each of said support walls including a lug projecting transversely therefrom beyond said side edges and opposite said channel for resisting displacement of an adjacent forming panel in a rearward direction;

an attachment member connected to said each of said support walls proximate said rear margin, each said attachment member including a leg extending transversely from said wall; and an aperture in said face panel and a connecting member extending through said aperture and abutting said rear margin for resisting displacement of said stiffback in a direction transverse to said face panel.

* * * * *